US006668816B1

(12) United States Patent
Pedersen et al.

(10) Patent No.: US 6,668,816 B1
(45) Date of Patent: Dec. 30, 2003

(54) CONCRETE STONE TEXTURING MACHINE, METHOD AND PRODUCT

(75) Inventors: Hans Pedersen, Frederikssund (DK); Charles Ciccarello, 8750 San Francisco, Brossard Quebec (CA), J4X 2S7

(73) Assignee: Charles Ciccarello, Brossard (CA)

( * ) Notice: Subject to any disclaimer, the term of this patent is extended or adjusted under 35 U.S.C. 154(b) by 0 days.

(21) Appl. No.: 10/268,775

(22) Filed: Oct. 11, 2002

(30) Foreign Application Priority Data

Jul. 10, 2002 (CA) ..... 2392934

(51) Int. Cl.[7] ..... B28D 1/32

(52) U.S. Cl. ..... 125/23.01; 125/13.01; 125/6; 451/337

(58) Field of Search ..... 125/23.01, 13.01, 125/6, 12; 451/336, 186, 337, 182

(56) References Cited

U.S. PATENT DOCUMENTS

| | | | | | |
|---|---|---|---|---|---|
| 2,867,204 | A | | 1/1959 | Arvay | |
| 2,912,969 | A | | 11/1959 | Masson | |
| 2,958,163 | A | * | 11/1960 | Cammerzell, Jr. | 451/68 |
| 3,067,731 | A | * | 12/1962 | Potter et al. | 125/3 |
| 3,660,214 | A | * | 5/1972 | Nichols et al. | 428/48 |
| 3,918,210 | A | * | 11/1975 | Mori | 451/190 |
| 4,048,977 | A | * | 9/1977 | Jenkins | 125/23.01 |
| 4,393,856 | A | * | 7/1983 | Gebhart | 125/3 |
| 4,557,246 | A | * | 12/1985 | Seeley | 125/26 |
| 4,691,684 | A | * | 9/1987 | Negron-Crespo | 125/3 |
| 5,085,008 | A | * | 2/1992 | Jennings et al. | 451/184 |
| 5,316,465 | A | * | 5/1994 | Hummel | 425/343 |
| 5,496,206 | A | * | 3/1996 | Young | 451/260 |
| 5,758,634 | A | * | 6/1998 | Ellison, Jr. | 125/23.01 |
| 6,109,906 | A | * | 8/2000 | Castonguay et al. | 425/343 |
| 6,540,501 | B1 | * | 4/2003 | Bott | 425/385 |

* cited by examiner

*Primary Examiner*—George Nguyen
(74) *Attorney, Agent, or Firm*—Ogilvy Renault; Guy J. Houle

(57) ABSTRACT

A concrete stone texturing machine, method and a stone having an irregular rough surface resembling a real stone face is described. The machine conveys concrete stones having opposed flat surfaces to a pitching station having at least one pair of opposed pitching blade assembles aligned in a common plane on a respective side of the pitching station. The pitching blade assemblies are displaced towards and away from one another a predetermined distance. Each assembly has a plurality of pitching blades secured in side-by-side aligned relationship. Each of the pitching blades has a forward projecting cutting edge and a securing body portion. A first group of the pitching blades has their cutting edges aligned along a first straight cutting axis which is offset from the cutting edges of the second group of pitching blades aligned along a second straight cutting axis. The cutting axes are parallel to one another. With the offset cutting edges a unique appearance of the pitched blocks surface is obtained when the pitching blades are forced to penetrate a predetermined distance in an associated one of the surrounding transverse faces of the block adjacent a surface to be pitched.

43 Claims, 11 Drawing Sheets

CONCRETE STONE TEXTURING MACHINE, METHOD AND PRODUCT

TECHNICAL FIELD

The present invention relates to a concrete stone facing machine, its method of operation and the resulting concrete stone block having an irregular rough surface which is chipped to resemble a real stone face.

BACKGROUND ART

There has been a need for several decades to develop a machine capable of facing stones by chipping the stone to form a rough surface resembling a real stone. For example, in U.S. Pat. No. 2,867,204, issued on Jan. 6, 1959, there is proposed a machine which is provided with two opposed chisels which are disposed against opposed surfaces of a stone adjacent a face to be roughened. These chisels are impacted by hammers whereby to simulate a conventional method that a mason uses to chip a stone. U.S. Pat. No. 2,912,969, also issued in 1959, describes a stone dressing and planing machine which utilizes a pair of opposed vertically movable, horizontal blades and a pair of vertical blades operated by rams. These pair of blades are actuated in unison, one after the other whereby to square face stone blocks or rubble stones which are used for erecting buildings. This machine is not for chipping a stone to form an irregular rough surface to resemble a real stone face.

More recently, with the advent of paving stones formed from concrete molds, a need has developed to roughen these prefabricated stones to resemble a real stone which has rounded and fragmented edges and surfaces. This is usually done by tumbling the stones in large cylindrical tumblers whereby the stone impacts abrading elements provided on an inner surface of the cylindrical containers as well as impacting one another. This has been a costly and hazardous operation as a percentage of the tumble stones will fragment and then have to be discarded. They are also labour intensive, result in injuries and the operation is very physical requiring shift work of short duration. However, this roughened or abraded process is only superficial on the surfaces and edges of the block and do not deeply penetrate the surfaces. Real stone faces have a deeper and irregular texture which these machines and process cannot achieve.

DISCLOSURE OF INVENTION

It is a feature of the present invention to provide a concrete stone facing machine which substantially overcomes the disadvantages of the prior art and meets the needs for production of concrete stones having a projecting irregular front rough surface to resemble a real stone face.

According to a further object of the present invention there is provided a method of forming a projecting irregular rough surface in a face of a concrete stone having opposed flat faces whereby the front face is textured to resemble a real irregular stone face.

According to a still further feature of the present invention, there is provided a pitching blade assembly for use in a concrete stone facing machine whereby to pitch a concrete stone about its periphery to form an irregular rough projecting front face.

According to a still further feature of the present invention there is provided a concrete stone having opposed flat walls surrounding a projecting irregular rough front face resembling a real stone face.

According to the above features, from a broad aspect, there is provided a concrete stone facing machine comprising means to convey a stone having opposed flat surfaces to a pitching station where a predetermined one of said surfaces of said stone is to be pitched to form a deep irregular rough surface to resemble a real stone face. At least one pair of opposed pitching blade assemblies are aligned in a common plane on a respective side of said pitching station. Means is provided to displace each of the pitching blade assemblies towards and away from one another a predetermined distance. Each pitching blade assembly has a plurality of pitching blades secured in side-by-side aligned relationship. Each pitching blade assembly has a forward projecting cutting edge and a securing body portion. A first group of the pitching blades has their cutting edges aligned with a first straight cutting axis which is offset from the cutting edges of a second group of pitching blades and aligned along a second straight cutting axis. The cutting axes are parallel to one another.

The present invention also provides a method of forming a deep irregular rough surface in a face of a concrete stone having flat faces whereby said face is textured to resemble a real irregular chipped stone face. The method comprises the steps of: i) Conveying a concrete stone in a predetermined oriented position to a loading station adjacent a pitching station. ii) Arresting said stone at a predetermined position at said loading station in alignment with said pitching station. iii) Providing at said pitching station two pairs of opposed blade assemblies, one pair being horizontal pitching blade assemblies and another pair being vertical pitching blade assemblies. Each of the pitching blade assemblies have a plurality of pitching blades secured in side-by-side relationship. Each pitching blade has a forward projecting cutting edge and a securing body portion. A first group of the pitching blades has their cutting edges aligned with a first straight cutting axis which is offset from the cutting edges of a second group of pitching blades aligned along a second straight cutting axis. The cutting axes are parallel to one another. The pitching blade assemblies lie in a common vertical plane. iv) Positioning the stone by pusher means to the pitching station with the face to be textured projecting a predetermined distance within the common plane. v) Displacing the pitching blade assemblies simultaneously to cause the pitching blades to move into surrounding, substantially transverse, surfaces of the face a predetermined distance to chip the face to form an irregular rough surface. vi) Discharging the concrete block with the chipped irregular rough surface.

The present invention also provides a pitching blade assembly for use in a concrete stone facing machine to pitch a concrete stone to form a deep irregular rough surface in a face of the stone surrounded by opposed flat surfaces. The pitching blade assembly comprises a blade holder and a plurality of pitching blades secured in side-by-side aligned relationship to he blade holder. Each said pitching blade has a forward projecting cutting edge and a securing body portion. A first group of the pitching blades has a forward projecting cutting edge and a securing body portion. A first group of the pitching blades has their cutting edges aligned with a first straight cutting axis which is offset from the cutting edges of a second group of pitching blades aligned along a second straight cutting axis. The cutting axes are parallel to one another.

The present invention still further provides a concrete stone having opposed flat walls surrounding a deep irregular rough surface resembling a real stone face. The opposed flat walls have, immediately adjacent the deep rough surface, two groups of spaced apart blade indentations aligned along respective straight parallel axes with at least some of the blade indentations being fragmented or partially fragmented.

BRIEF DESCRIPTION OF THE DRAWINGS

A preferred embodiment of the present invention is now described with reference to the following drawings in which.

MODES FOR CARRYING OUT THE INVENTION

Figure 11:
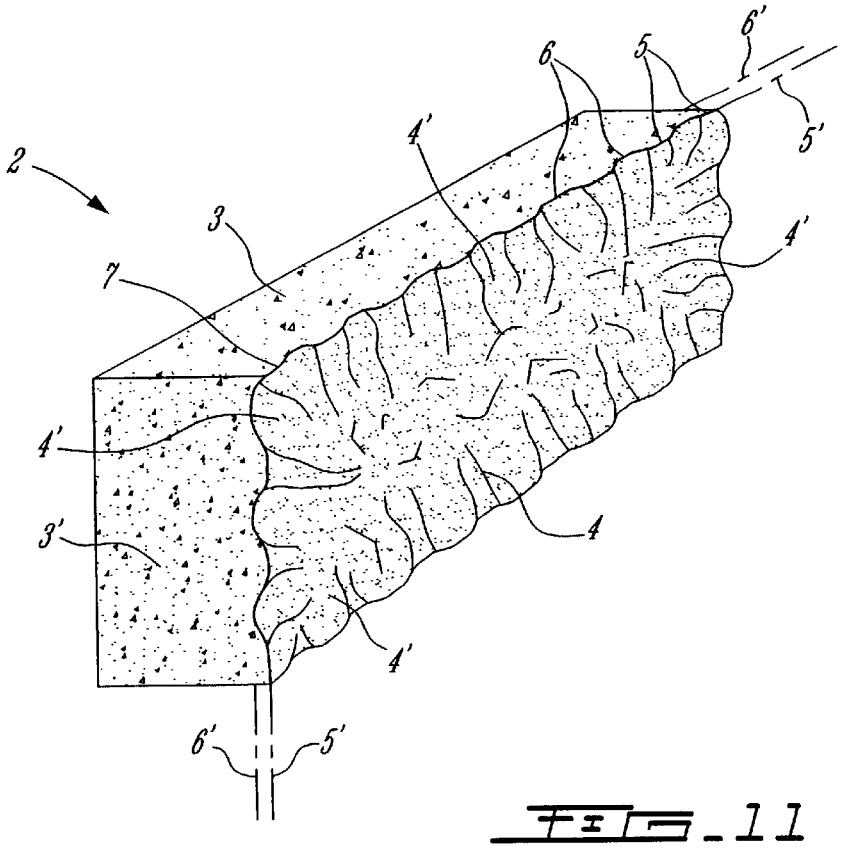
FIG. 11 is a perspective view of a concrete stone having a deep irregular rough surface formed with the machine and method of the present invention.

Referring now to the drawings, and more particularly to FIGS. 1 to 4, there is illustrated a concrete stone facing machine 1 constructed in accordance with the present invention whereby to fabricate the concrete stone 2, as illustrated in FIG. 11, which is formed with opposed surrounding flat walls 3 and 3' and having a projecting irregular rough front surface 4 which resembles a real stone face. As shown in FIG. 11, the stones produced by the machine 1 of the present invention have in their opposed flat walls, and immediately adjacent the deep rough contour of its front surface 4, two groups of spaced apart blade indentations, namely, group 5 and group 6 of blade indentations and which are aligned along respective straight, parallel axes 5' and 6'. These are also present on the side faces 3'. These blade indentations and their offset are herein shown exaggerated to illustrate that there is a small spacing between them to achieve the texturing of the front face 4 of the concrete stone. The concrete stone produced also has some of its blade indentations 5 and 6 which are fragmented or partly fragmented, as illustrated by reference numerals 7 and this is due to the aggregate in the stone and the configuration of the pitching blades as will be described later on. As also shown in FIG. 11, these blade indentations are substantially of equal lengths but this is not essential. It is further pointed out that one of the groups, group 6, of blade indentations are deeper than the indentations of the other group and this results in achieving a deep irregular rough surface configuration, particularly in the outer peripheral regions 4' of the front surface 4. The two groups of indentations are also formed in alternate sequence along the respective straight parallel axes, but this alternate sequence is also not essential and it is conceivable that this sequence could be irregular.

The reference to "pitching" as used herein means that a face of a concrete block is given a deep irregular rough surface by chipping said surface by the use of blades penetrating surrounding substantially transverse surfaces of the face of the block to be pitched such that irregular size stone chips are broken off the surface being chipped. Before the concrete stone 2 is pitched, a large square stone usually twice the size of the stone 2 is split in half to produce a rough aggregate surface 4. The blades then pitch the stone about a contour edge portion to chip the stone to form deep indentations so that the face 4 projects forwardly and is rough like a real stone.

Figure 12:
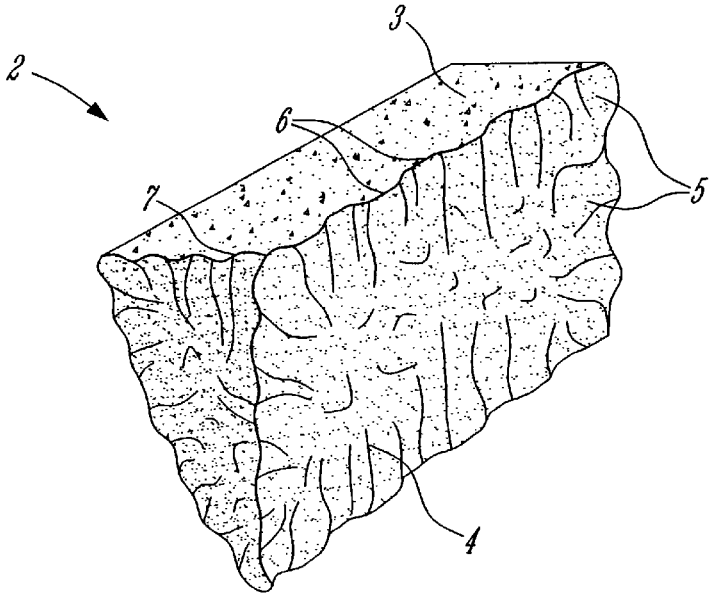
FIG. 12 is an enlarged view of a fragmented portion of the stone of FIG. 11.
Figure 13:
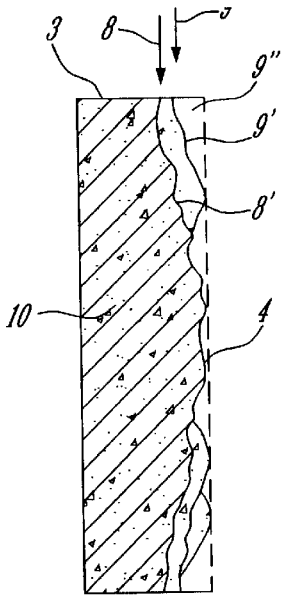
FIG. 13 is a transverse cross-sectional view illustrating the deep irregular rough surface formed in a face of the concrete stone.

As shown in FIGS. 12 and 13, the indentations formed by the pitching blade illustrated by arrow 8 produces a much deeper cut into the stone face 3 which results in a large deeper chip being broken off the stone face 4 as illustrated by the fragmented surface 8'. The alternate pitching blade indentation formed by the pitching blade illustrated by arrow 9, produces a smaller irregular chip illustrated by the fragmented surface 9' and the chip 9". Because these blades are alternate or are disposed in a predetermined sequence, they produce alternate rough cuts which are deep and shallow and the fragmentation also depends on the aggregate composition of the concrete stone which is not predictable. Accordingly, all of the pitched stone faces produced by the concrete stone facing machine 1 of the present invention are different from one another.

Reverting now to FIGS. 1 to 4, there will be described the construction and operation of the concrete stone facing machine 1 of the present invention. The machine 1 has a frame 1' to which is mounted an infeed conveyor 10 which feeds concrete stones 11 having a rough front face 11', caused by a larger stone having been split. The front face 11' is surrounded by opposed flat parallel surfaces adjacent thereto. The infeed conveyor 10 is formed by a plurality of feed rolls 12 which are driven by an endless chain drive, not shown but concealed in a chain housing 13 whereby to rotate the feed rollers 12 and feed stones 11 to the machine, in a controlled manner. The spacing between the stones 11 is synchronized with the machine operation.

As the stones 11 are fed to the machine in the direction of arrow 14, they will be stopped at a predetermined position as dictated by a stop bar 15. The stop bar 15 is adjustably positioned by a motor driven assembly 16 as will be described later. The positioning of the stop bar is to precisely align the stones 11 conveyed thereto in relation to a pitching station 17, as better illustrated in FIG. 4, and the size of the stone. The control unit 100 is inputted information signal concerning the stone sizes and quantities and controls the operation of the stop bar motor drive assembly 16.

Figure 5:
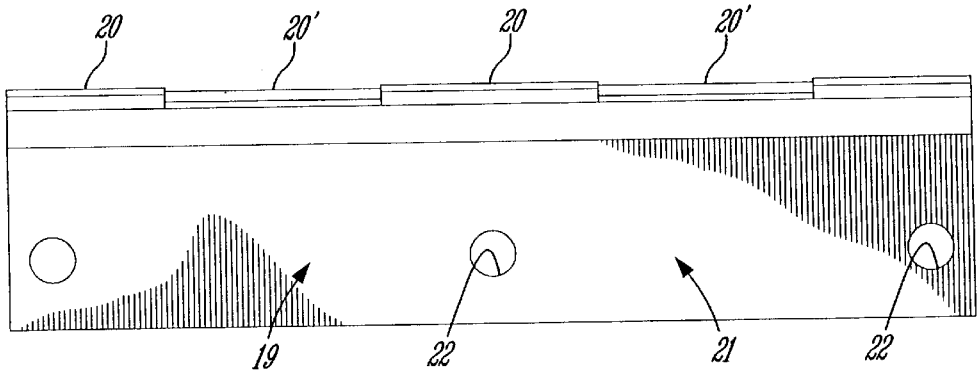
FIG. 5 is a plan view of a pitching blade assembly.

At the pitching station 17, there is provided at least one pair of opposed pitching blade assemblies 18 and 18' and as hereinshown there are two pairs of pitching blade assemblies, namely a horizontal pair 18 and 18' and a vertical pair of pitching blade assemblies 19 and 19'. As shown in FIG. 5, wherein there is illustrated the vertical pitching blade assembly 19, each blade assembly comprises a plurality of pitching blades 20 secured in side-by-side aligned relationship and are secured to a blade holder 21 provided with holes 22 whereby to secure same to a piston connecting frame 23 which is displaced by a hydraulic cylinder 24. The blade holder is maintained in a perfectly vertical plane by guide rods 25 secured in a guide frame 26. This type of arrangement is also provided for each of the opposed pitching blade assemblies which are each provided with their own hydraulic cylinders 24. With additional reference to FIG. 7, it can be seen that there are two groups of pitching blades and they are hereinshown as secured to the pitching blade holder 21 in alternating side-by-side relationship. Thus, there is a first group 20 of blades and a second group 20'.

Figure 7:
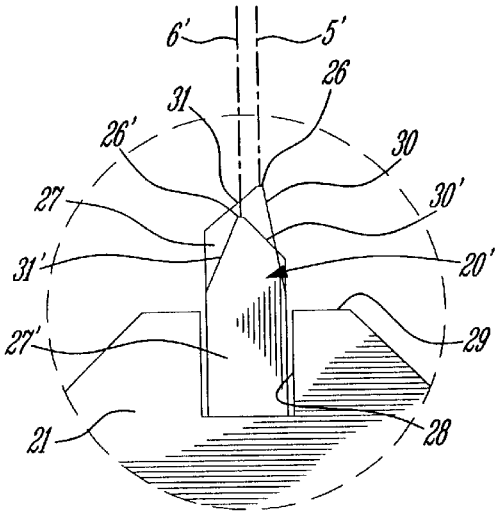
FIG. 7 is an enlarged view illustrating the construction of the pitching blades and their offset alignment.

As better illustrated in FIG. 7, each of the pitching blades 20 and 21 have a forward projecting cutting edge 26 for blade 20 and 26' for blade 20' and securing body portions 27 and 27'. These body portions 27 and 27' are secured in a channel 28 formed in a front face 29 of the holder 21 and secured therein by a two-component glue material, well known in the art, or other means.

A first group, namely pitching blades 20, have their straight cutting edges 26 aligned along a first straight cutting axis 5' which corresponds to the axis as previously described with reference to FIG. 11 and the second group of pitching blades 20' have their straight cutting edge 26' aligned along a second straight cutting axis 6'. As also shown in FIG. 7, the second group of pitching blades 20' have their straight cutting edge recessed below the projecting cutting edge 26 of the first group. They are also recessed rearwardly thereof a distance as illustrated by the offset of the axes 5' and 6'. Also, the cutting heads of these two groups of pitching blades are differently configured from one another whereby to obtain the deep irregular rough surface 4 in the chip stone face.

Again referring to FIG. 7, it can also be seen that the cutting heads have a transverse pyramidal shape which defines a forward rearwardly inclined front bevel face 30 for pitching blade 20 and 30' for pitching blade 20' leading to their respective elongated straight cutting edges 26 and 26', and a rearwardly inclined rear bevel face 31 and 31' respectively, depending from their respective cutting edges 26 and 26'. The front bevel faces 30 and 30' and the rear bevel faces 31 and 31' from both groups of pitching blades, extend at different angles. As hereinshown the front bevel faces of the cutting blades of the first group 20 extend at a common angle which is different than their rear face 31. These angles are also different than the cutting blades of the second group, as above mentioned. As hereinshown, the front bevel face 30' of the second group of pitching blades 20' are shallower (less steep) than their rear bevel face 31'. Also, the front bevel faces 30 of the cutting heads of the first group of pitching blades are much steeper than their rear bevel face 31 whereby to chip different size concrete chips from a stone face to form the deep irregular rough surface when the pitching blades are pitched to penetrate the flat surfaces adjacent the face to be chipped. Also, the front bevel faces 30 of the first group of pitching blades are much steeper than those of the second group of pitching blades.

Figure 6:
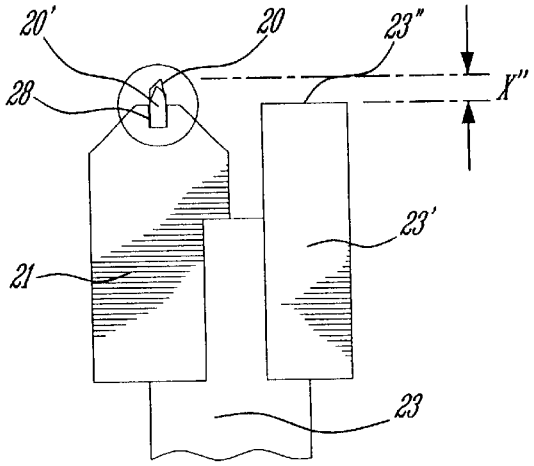
FIG. 6 is an end view of FIG. 5.

As shown in FIG. 6, the blade holder 21 is secured to the frame 23 by suitable fasteners, not shown. Also secured to the frame 23 is a stopper bar 23' which has an abutment face 23" to abut a surrounding surface 3 or 3' of a stone 2 to be pitched. The spacing between the leading cutting edge 26 of the blade 20 and the abutment face 23" defines the penetration of the blades within the stone being pitched. This stopper bar 23' can also be referred to as an equalizing bar as it ensures that opposed surfaces of a stone are penetrated an equal distance by opposed parallel blade assemblies. That is to say, if one blade assembly penetrates the block an instant before the other blade assembly of a pair, it will provide a backing until the other assembly fully penetrates by its piston stroke. Of course, we are talking of a fraction of a second. The distance of penetration "x", as shown in FIG. 6, is adjustable by changing the stopper bar 23' and a preferred distance of penetration for a 12 inch block is about 8 mm.

Figure 1:
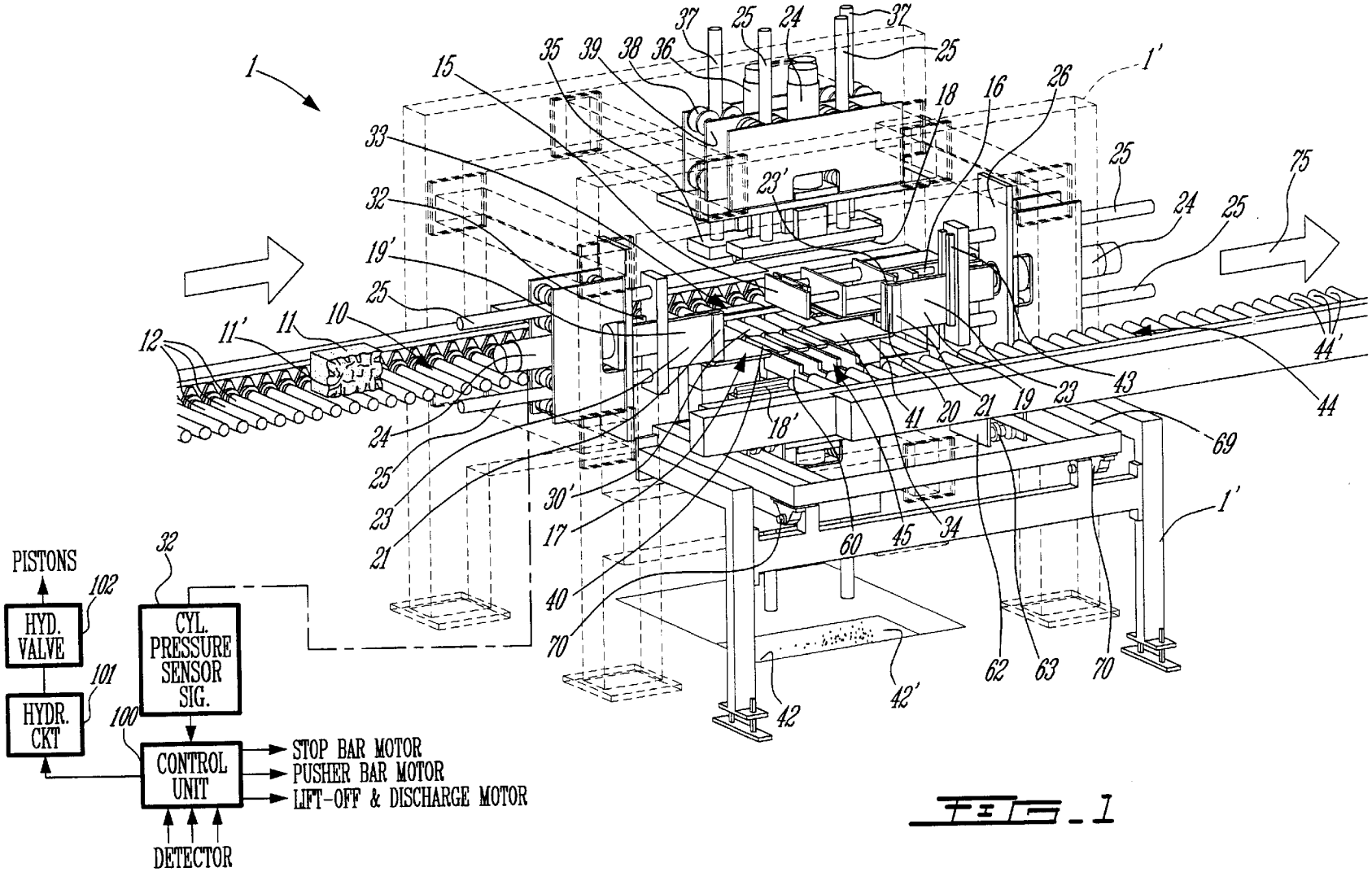
FIG. 1 is a front perspective view of the concrete stone facing machine with the frame of the machine illustrated in phantom lines.
Figure 2:
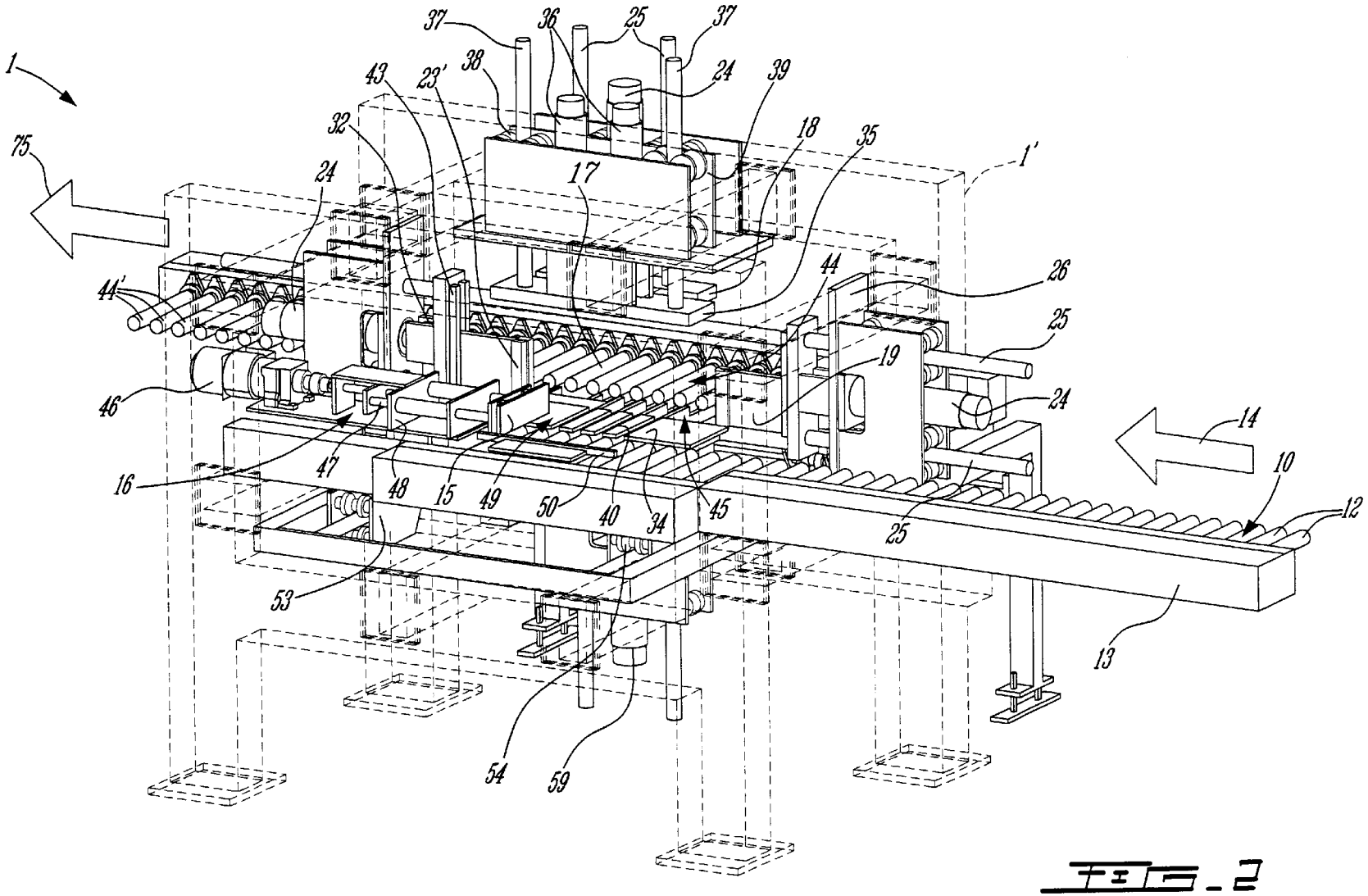
FIG. 2 is a perspective view similar to FIG. 1, but viewed from the rear of the machine.
Figure 3:
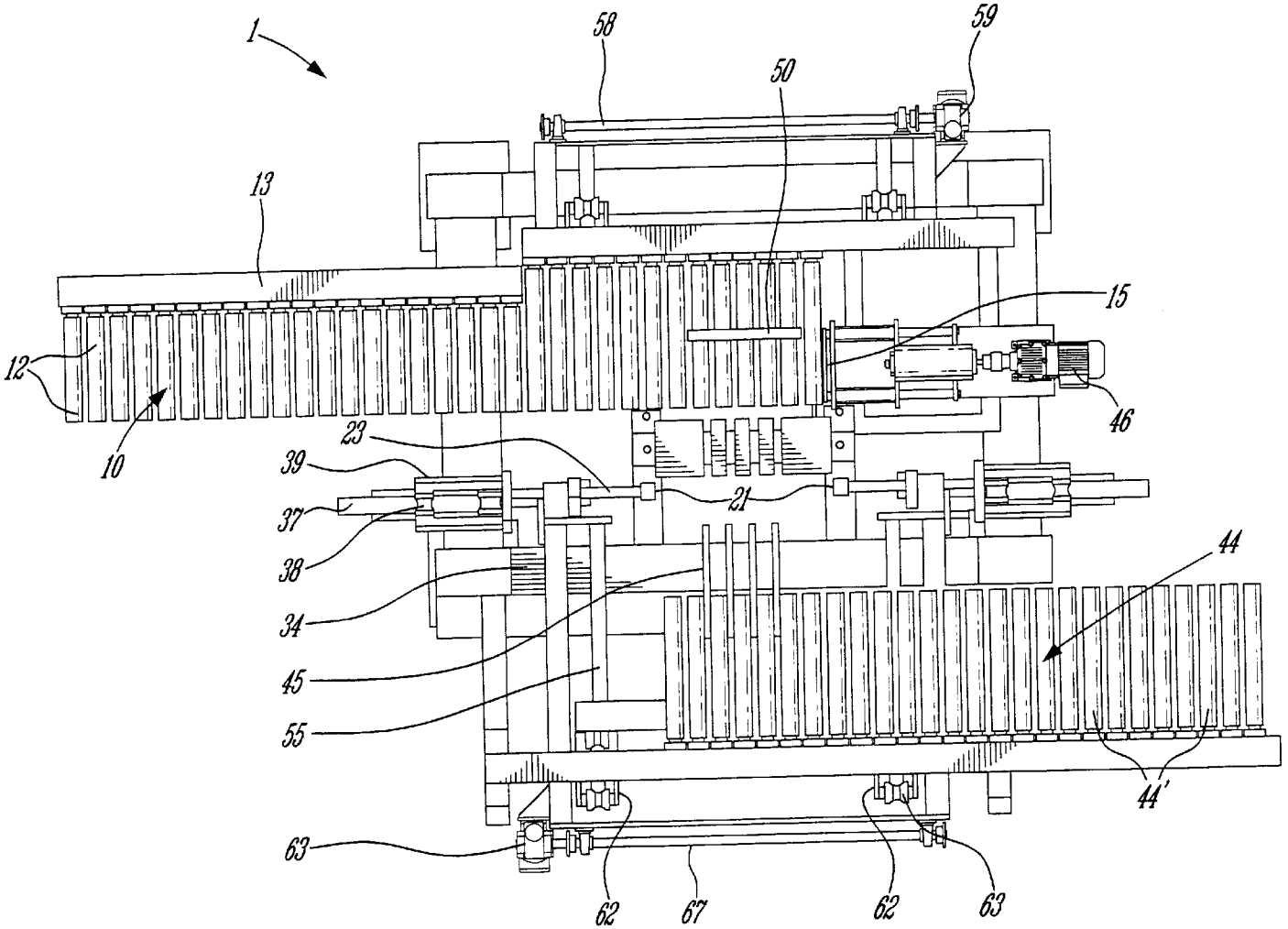
FIG. 3 is a top view of the concrete stone facing machine of the present invention.
Figure 4:
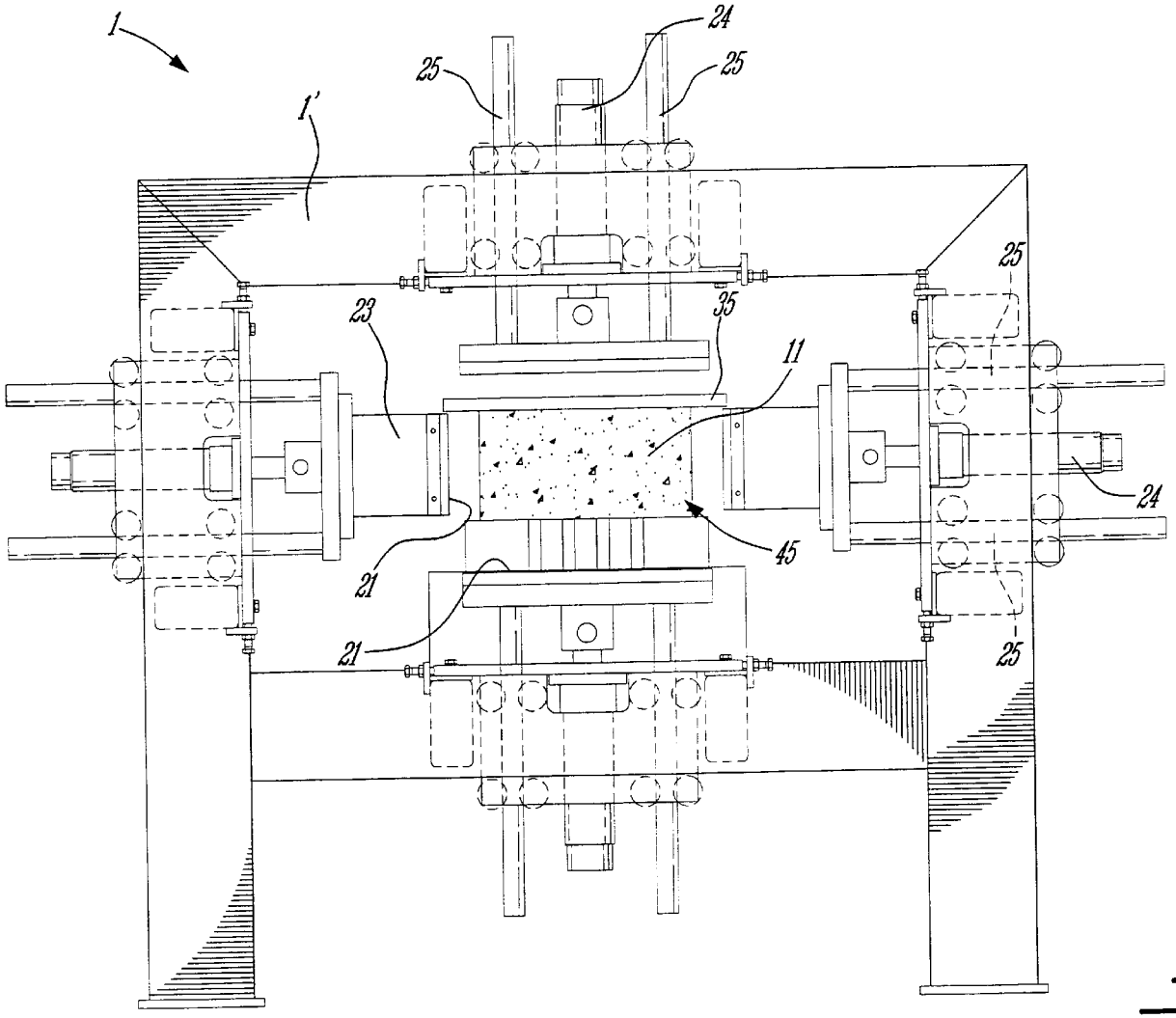
FIG. 4 is a front view thereof, illustrating the pitching station and the pitching blade assemblies.

As shown in FIG. 1, there are two pairs of opposed pitching blade assemblies, namely the horizontal pitching blade assemblies 18 and 18' and the vertical pitching blade assemblies 19 and 19' and they are all aligned in a common vertical plane at the pitching station 17. It is also pointed out that the piston connecting frames 23 supporting each of the pitching blade assemblies are each provided with a pressure sensor 32 to sense the resistance, namely when the cutting edge 26 which is the most projecting edge of the groups of pitching blades, contacts their respective opposed flat side surfaces 3 and 3' of a stone 11 to be pitched. Their respective cylinders 24 advance the cutting edges to contact the stone faces and then momentarily stop. As soon as all stone faces have been contacted by each of the pitching blade assemblies or by a pair of blade assemblies if a stone is pitched alternately by the horizontal blades and then the vertical blades, the cylinder will displace the cutting heads into the surfaces at a higher pressure as controlled by the controller 100 and the hydraulic circuit 101 and hydraulic valve 102. The stroke or penetration is limited by the stopper bar 23'. The penetration is usually set between 4 to 10 mm depending on the size of the block. This will cause concrete stone material to be pitched off the surface surrounding the opposed flat side walls and give the fragmented stone face 4 a much deeper fragmented appearance.

It is pointed out that the machine also comprises a pushing bar assembly 33 which pushes a stone 11, which is arrested by the stop bar 15, to a precise position at the pitching station 17 onto a pitching platform 34 with the front face 4 of the stone 11 projecting beyond the plane defined by the opposed cutting edges of the pitching blade assemblies. This positioning of the stone is preprogrammed, depending on the size and configuration of the stones 11 being pitched. Pitching bar assembly 33 will be described later, but is controlled by a motor drive to slowly displace the stone from the stop bar and move it to the pitching station and slowly position it at the proper location. Once the stone reaches its proper position, a top clamp bar 35 clamps the stone on the pitching platform 34 and the pitching blade assemblies are displaced in pairs or all at the same time to contact the stone and momentarily arrested before their cylinders actuate their second stroke at higher pressure to fragment the stone face. The clamp bar 35 is supported on guide rods 37 secured between guide wheels 38 disposed between guide plates 39.

The hydraulic cylinders 24 of each group of pitching blade assemblies, namely the horizontal and vertical groups, are controlled by respective hydraulic valves 102 whereby the pressure sensors 32 would provide signals to the controller 100, which then operate the hydraulic cylinder to effect their second stroke. It is pointed out that the cylinders 24 are actuated in pairs or simultaneously to effect the second stroke whereby the stone face is fabricated in a single cycle or two cycles. Of course, the vertical blade assemblies are shorter to move between the horizontal assembly during the second stroke.

As shown in FIG. 1, the pitching platform 24 is a slotted platform provided with slots 40. The platform also has a projecting edge 41 and is open thereunder. A pit 42 is provided under the pitching station 17 whereby chipped concrete particles and dust particles would fall directly into the pit 42 which is provided with a conveyor 42' to convey debris away from the machine. The frames 23 secured to the blade holders 21 are secured to an intermediate frame 43 by an articulated connection, not shown, to compensate for irregularities in the flat surfaces of the stones which are contacted by the blade. These irregularities are usually very small irregularities which are often not visible to the eye.

After the stone has been chipped by the pitching blade assemblies, these assemblies are retracted and the stone is then transferred to a discharge conveyor 44 by a stone discharge and lift-off assembly 45 as will later be described.

Figure 8A:
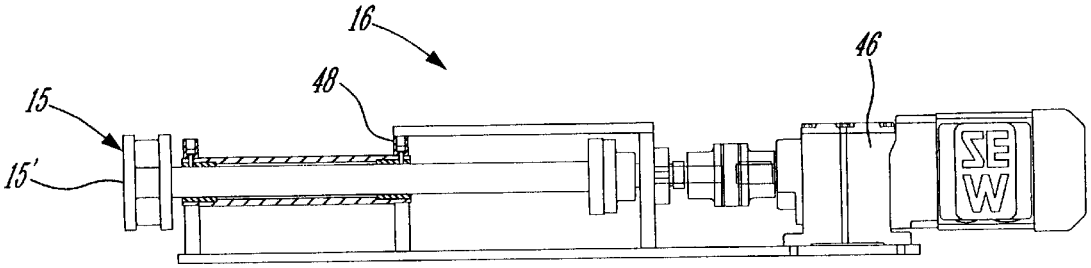
FIG. 8A is a side view of a stop bar assembly.
Figure 8B:
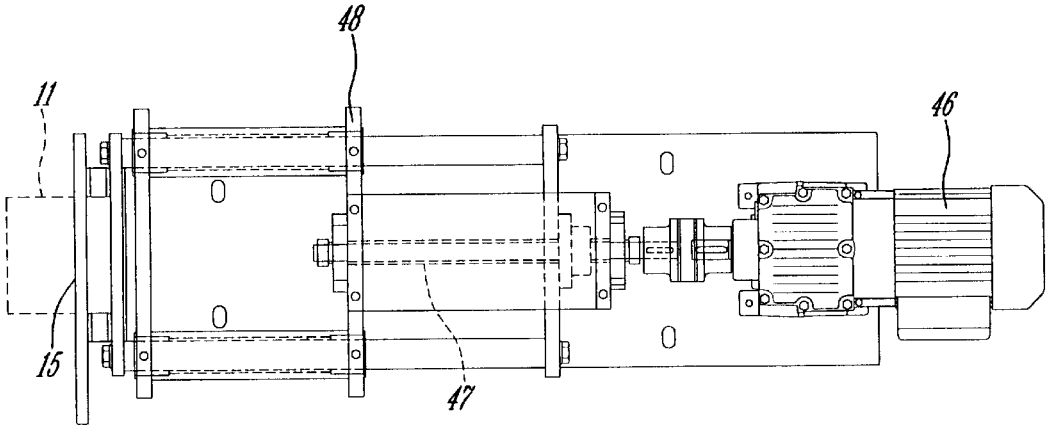
FIG. 8B is a top view of FIG. 8A.

Referring now to FIGS. 8A and 8B, there is shown the construction of the stop bar assembly 16 which positions the stop bar 15 at a precise position to receive a concrete block and align it with the pitching station 17. The stop bar assembly 16 comprises a motor 46 which operates a treaded shaft 47 whereby to slowly displace the stop bar support frame at the proper location, as determined by the controller 100, over the infeed conveyor 10. As hereinshown the stop bar 15 is of sufficient length whereby the stone 11 has a surface thereof flush with the outer surface 15' of the stop bar 15 to ensure good contact and proper positioning. The infeed drive conveyors maintain the stone flush thereagainst at the loading station 49. Whenever different size stones are required to be pitched, the control unit 100 will automatically actuate the motor 46 to position the stop bar 15 at the proper position to center the stone with respect to the pitching blades at the pitching station. Accordingly, the entire machine is automated to handle different size stones.

Figure 9A:
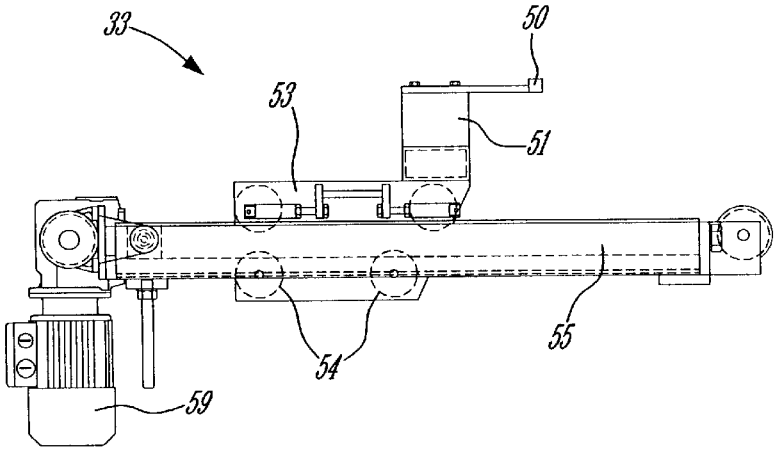
FIG. 9A is a side view of the pusher bar assembly.
Figure 9B:
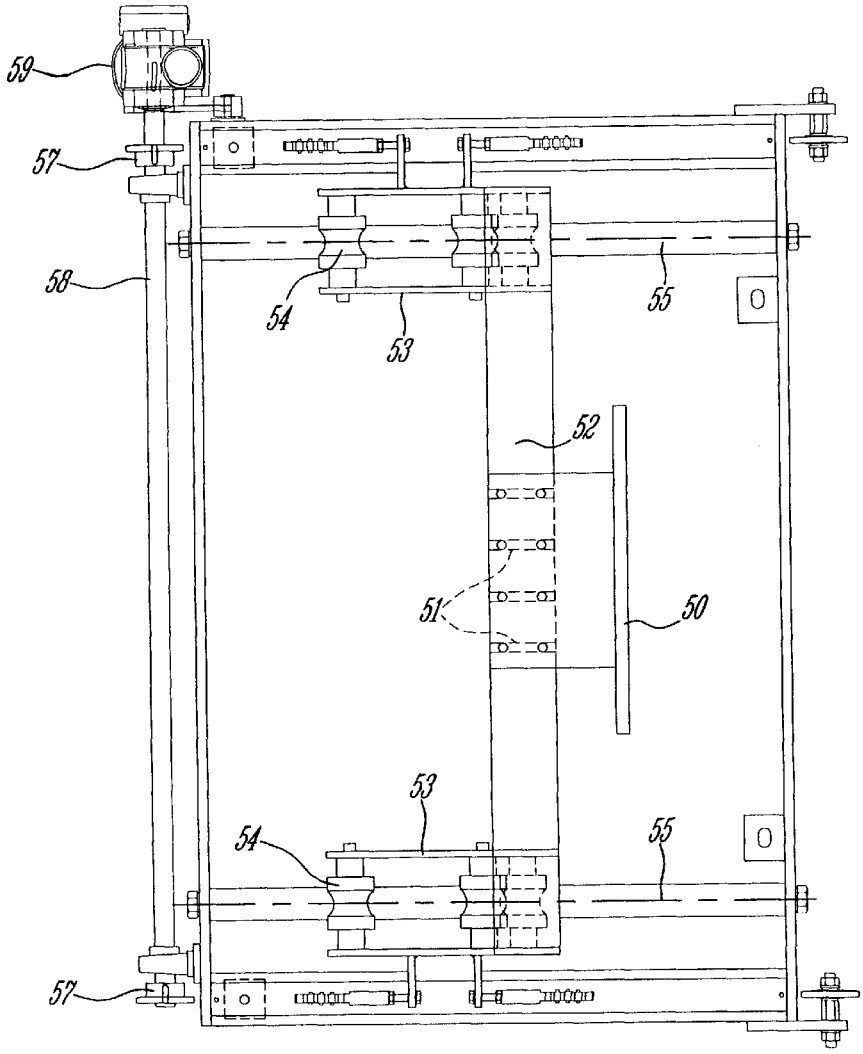
FIG. 9B is a top view of the pusher bar assembly of FIG. 9A.

With reference now to FIGS. 9A and 9B, there is shown the construction of the pusher bar assembly 33 which is secured under the infeed conveyor with the pusher bar projecting between conveyor rolls 30'. For this purpose, the pusher bar 50 is secured to vertical flanges 51 which project between the rollers 10'. The vertical flanges are secured to a bar 52 which is secured to opposed carriages 53 having guide wheels 54 secured to each side of opposed guide rods 55. The carriages are connected to endless chains 56 which are wound about drive sprockets 57 which are secured to a drive rod 58 which is rotated by a motor 59. The operation of the motor 59 is synchronized with other operating assemblies and components of the machine and controlled by the controller 100 whereby to engage a rear surface of a block which is held by the stop bar and push it slowly into precise position over the pitching platform 34 with the forward face of the stone projecting beyond the plane of the pitching blades a predetermined distance over the projecting edge 41 of the platform 34.

Figure 10A:
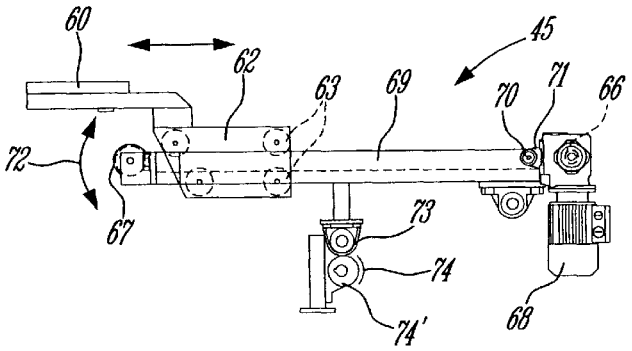
FIG. 10A is a side view of the stone discharge lift-off assembly.
Figure 10B:
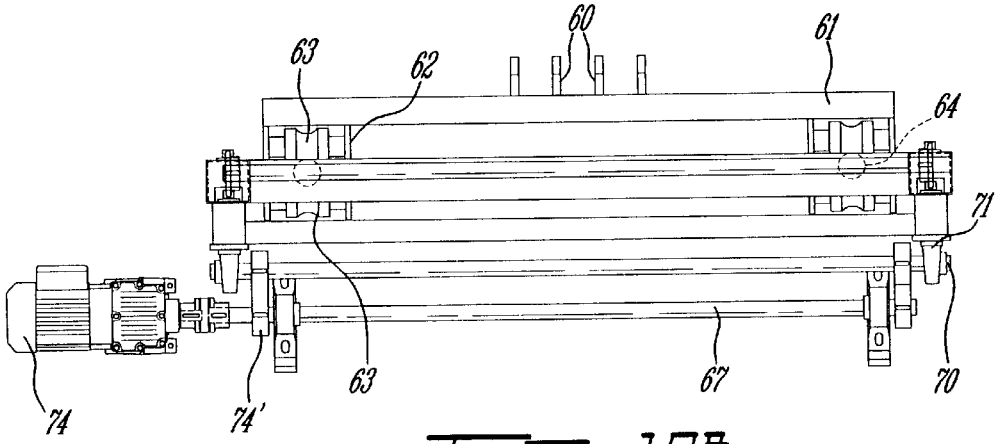
FIG. 10B is a right end view of FIG. 10A.
Figure 10C:
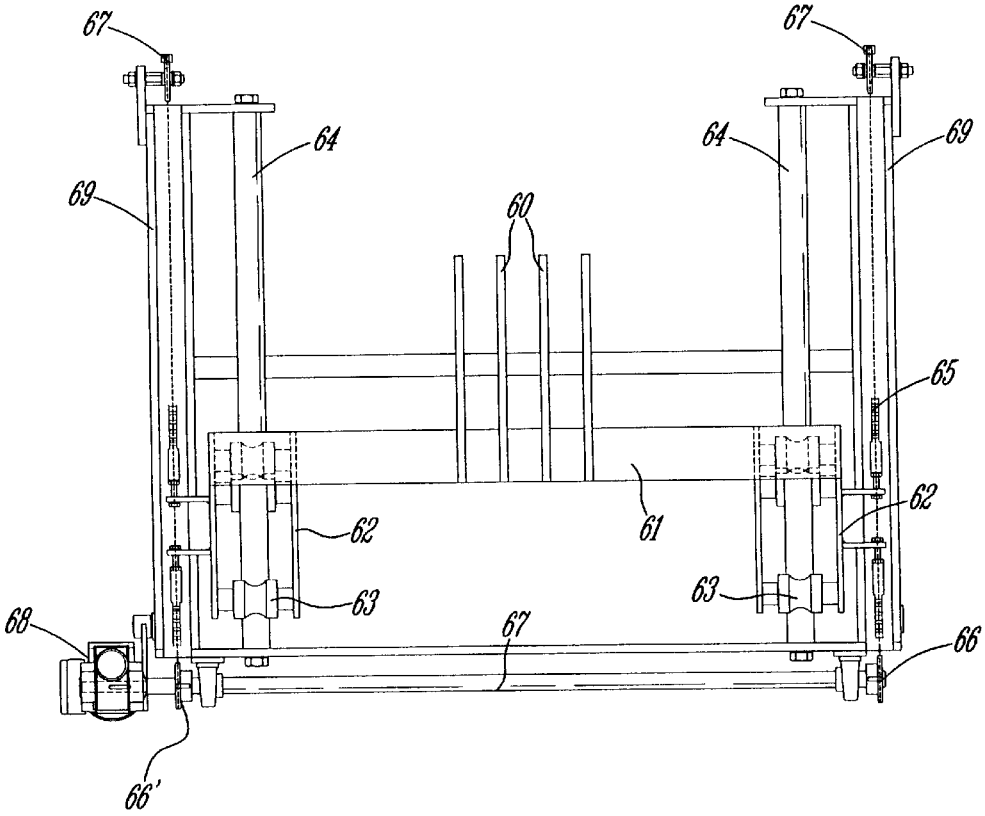
FIG. 10C is a top view of FIG. 10A.

With reference now to FIGS. 10A to 10C, there is shown the construction of the stone discharge and lift-off assembly 45. The assembly 45 consists of transfer fingers 60 which are held in parallel side-by-side spaced relationship as shown in FIG. 1 and are disposed in alignment with the slots 40 provided in the pitching platform and centrally located with respect to the pitching station 17. The transfer fingers 60 are secured to a support bar 61 which is attached at opposed ends thereof to a carriage frame 62 provided with guide wheels or casters 63 also engaging opposed sides of a guide rod 64, as better illustrated in FIG. 10C. The carriage frame 62 is thus displaceable along the guide rod 64 and it too is secured to an endless chain 65 which is trained about a drive sprocket 66 and an idle sprocket 67.

Each of the carriages has a like endless chain drive trained about drive sprockets 66 and 66', respectively, which are secured to the drive rod 67 secured to a drive motor 68. As hereinshown, the frames 69, which support the carriage frame 62, are secured to a pivot rod 70 by bushings 71 whereby the frame assembly 69 can tilt up and down in the direction of arrow 72. A follower head 73 is secured to each of the frame assemblies and mounted on an eccentric cam 74' which is rotated by a cam motor 74 to cause the frame assembly to move up and down in the direction of arrow 72. The cam motor and drive motor are also driven in synchronism,by the controller 100.

When a stone is being pitched at the pitching station 17, the carrier frame 72 and the transfer fingers 60 are retracted away from the pitching station whereby the lower horizontal pitching blade assembly can move upwardly against the lower face of the projecting block. After the pistons have retracted, the carriage frame 62 is moved forwardly under the pitching platform 34. The cam 74 has been rotated to maintain the frame assembly in its lowermost position. Immediately upon the fingers reaching their forward stroke under the pitching platform 34, the eccentric cam is again rotated to lift the fingers 30 to project through the slots 40 of the pitching platform 34 to engagingly lift off the faced stone above the pitching platform 34 and retract it over the discharge conveyor. The transfer fingers 60 are also aligned between rollers 44' of the discharge conveyor and the eccentric cam is again rotated to lower the carrier frame 62 and transfer fingers 60 to deposit the pitched stone on the chain driven rollers of the discharge conveyor 44 and automatically convey the stone away in the direction of arrow 75 for further processing, surfacing and/or stacking.

Figure 14:
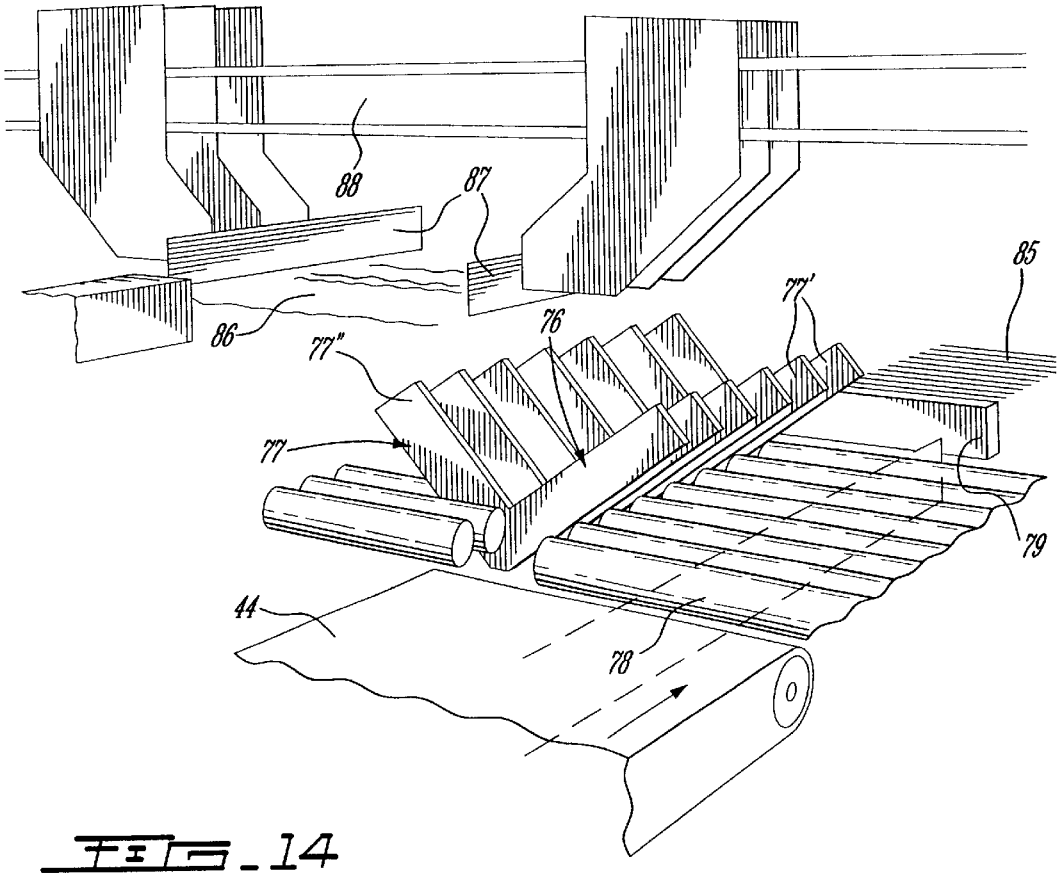
FIG. 14 is a perspective view illustrating a stone inverting cradle disposed along the conveyor line whereby to invert stones.

As shown in FIG. 14, when the stone 11 leaves the discharge conveyor, the deep roughened surface 4 lies vertical (sideways) on the discharge conveyor 44. If it is desirable to further work this surface 4 to smooth sharp edges and to further roughen the surrounding edges of the stone, it is necessary to re-orient the stone with the deep roughened surface 4 facing upwardly. This is achieved by an inverting cradle 76, as shown in FIG. 14 wherein a stone is inverted to be fed by a further conveyor 85. The cradle 76 can also invert a stone lying flat and stand it on its edge to be positioned on a squaring table 86 where a layer of stones is accumulated and positioned side-by-side by clamps 87 displaceable over the tale 86 on a transfer conveyor rail 88.

The cradle 76 consists of a series of right angle spaced-apart plates 77 which are disposed under a further driven roller conveyor 78 in front of a stop plate 79. The right angle plates 77, under the roller 78, are then actuated or titled whereby to rise above the roller 78 and engage the stone on its lowermost surface and tilt it on the second series of right angle fingers 77" so that the stone is inverted 90° and now lies with its roughened face facing upwardly.

Figure 15A:
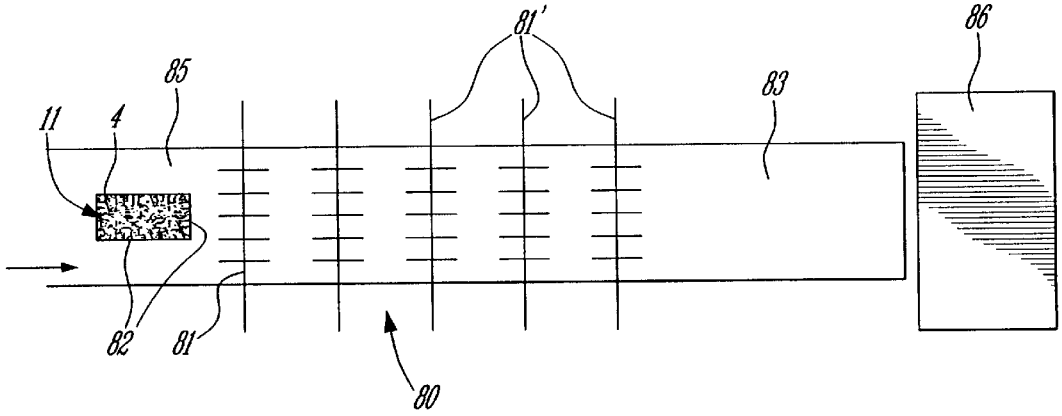
FIG. 15A is a simplified schematic view of a stone surfacing assembly.
Figure 15B:
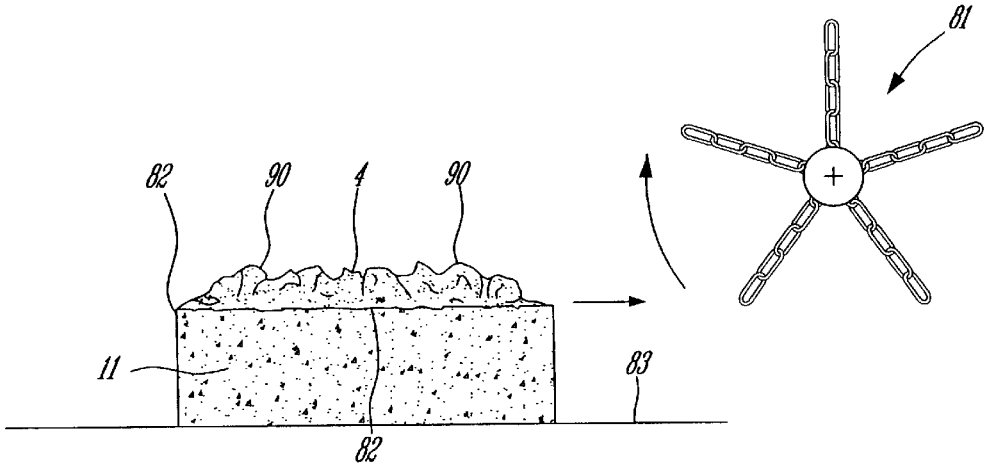
FIG. 15B is a side view of a stone to be treated by the surfacing assembly of FIG. 15A.

Referring to FIGS. 15A and 15B, there is shown a face smoothing and abrading station where a first series of rotating impacting chains 81 impact the roughened chipped face 4 of the stone 11 whereby to remove sharp stone points 90 and to further abrade the face and surrounding edges 82 of the stone 11 to give it a worn look. The conveyor 83 then continues to convey the stone under further smaller rotating chain assemblies 81' to provide a less abrading treatment of the surface and edges. At the end of this smoothing and abrading station the stone can be turned again to its original position for stacking and conveyed to a squaring table where the stones are accumulated in a layer and palletized. The stone smoothing and abrading equipment will not be described in detail as it forms part of another patent application.

Summarizing the operation of the concrete stone facing machine of the present invention, a concrete stone is conveyed at a predetermined oriented position to a loading station adjacent a pitching station of the machine. The stone is arrested at a predetermined position by a stop bar at the loading station and precisely aligned with the pitching station. The pitching station has two parallel pairs of opposed blade assemblies, one pair being a horizontal pitching blade assembly and the other pair being a vertical pitching blade assembly. Each of the pitching blade assemblies have a plurality of pitching blades secured in side-by-side relationship. Each of the pitching blades has a forward projecting cutting edge and a securing body portion. A first group of pitching blades have their cutting edges offset vertically and horizontally from the cutting edges of a second group of pitching blades and aligned along a straight cutting axis which is parallel to a first straight cutting axis of the cutting edges of the first group of pitching blades. The pitching blade assemblies lie in a common vertical plane.

The pusher bar positions the stone at the pitching station with the face to be pitched projecting a predetermined distance beyond the common plane and over a projecting edge of the pitching platform. A top clamping bar then clamps the stone against the platform. The pitching blade assemblies are sequentially displaced in pairs or simultaneously to cause the pitching blades to contact the surrounding surfaces of the walls about the face which projects a predetermined distance from the platform whereby to contact its associated surface of the stone. During a second stroke of the hydraulic cylinders, the stone surface is pitched to form the irregular rough surface with deep penetrations in its surrounding surface contour to give the face a deep rough texture and projection. The concrete block having been pitched all around is then discharged by a lift-off and discharge mechanism. The entire operation of the machine is automatically controlled by a controller which is preprogrammed to treat various sizes of stones.

The present invention is intended to cover obvious modifications, provided such fall within the definition of the accompanying claims which define the exclusive property of the present invention.

What is claimed is:

1. A concrete stone facing machine comprising means to convey a stone having opposed flat surfaces to a pitching station where a predetermined one of said surfaces of said stone is to be pitched to form a deep irregular rough surface to resemble a real stone face, at least one pair of opposed pitching blade assemblies are aligned in a common plane on a respective side of said pitching station, means to displace each said pitching blade assemblies towards and away from one another, each said pitching blade assemblies having a plurality of pitching blades secured in side-by-side aligned relationship, each said pitching blades having a forward projecting cutting edge and a securing body portion, a first group of said pitching blades having their cutting edges aligned with a first straight cutting axis which is offset from the cutting edges of a second group of pitching blades aligned along a second straight cutting axis, said first and second cutting axes being parallel to one another, said means to convey being a feed conveyor for feeding concrete stones to a loading station adjacent said pitching station, stop means to arrest a concrete stone to be pitched in alignment with said pitching station, pusher means to transfer said stone to be pitched from said stop means to a support platform of said pitching station with a face of said stone to be pitched projecting a predetermined distance beyond said common plane, clamp means to clamp said stone to be pitched on said support platform, and stop means to arrest the penetration of said, pitching blades in surrounding surfaces of said block to limit the penetration thereof to a preset distance.

2. A concrete stone facing machine as claimed in claim 1 wherein said securing body portions of said pitching blades are secured to a blade holder in a side-by-side abutting relationship.

3. A concrete stone facing machine as claimed in claim 2 wherein said stop means is a stop bar secured to piston connecting frames, said securing body of said pitching blades being connected to a respective one of said piston connecting frames, said stop bar having an abutment face disposed retracted said preset distance from an outermost one of said forward projecting cutting edge.

4. A concrete stone facing machine as claimed in claim 3 wherein said forward projecting cutting edge of each said pitching blades are straight cutting edges.

5. A concrete stone facing machine as claimed in claim 4 wherein said cutting edges of said second group of pitching blades aligned along said second straight cutting axis are recessed below said cutting edges of said first group of said pitching blades.

6. A concrete stone facing machine as claimed in claim 5 wherein said pitching blades are tungsten carbide blades and are secured to said blade holder by a two-component glue material.

7. A concrete stone facing machine as claimed in claim 5 wherein said cutting edges of said first group of pitching blades have a cutting head which is differently configured than the cutting head of said second group of pitching blades.

8. A concrete stone facing machine as claimed in claim 7 wherein said pitching blades are elongated rectangular blades, each blade having an elongated straight cutting edge, said cutting head having a transverse pyramidal shape defining a forward rearwardly inclined front bevel face leading to said elongated straight cutting edge and a rearwardly inclined rear bevel face depending downwardly from said cutting edge, said front bevel face and rear bevel face extending at different angles.

9. A concrete stone facing machine as claimed in claim 8 wherein said front bevel face of said cutting heads of said first group of pitching blades extend at a common angle different from a common angle of said rear bevel faces, said common angles of said front and rear bevel faces of said first group of pitching blades being different than the common angles of said front and rear bevel faces of said second group of said pitching blades.

10. A concrete stone facing machine as claimed in claim 9 wherein said front bevel faces of said cutting heads of said second group of pitching blades are shallower than their said rear bevel face, and wherein said front bevel faces of said cutting heads of said first group of pitching blades are steeper than their said rear bevel face whereby to chip different size concrete chips to form said deep angular rough surface when said pitching blades are pitched to penetrate surfaces adjacent a face to be pitched of a stone positioned therebetween, said face to be pitched lying in a vertical plane.

11. A concrete stone facing machine as claimed in claim 5 wherein alternate ones of said pitching blades form said first group of pitching blades.

12. A concrete stone facing machine as claimed in claim 5 wherein there are two pairs of opposed pitching blade assemblies, one pair being horizontal pitching blade assemblies and another pair being vertical pitching blade assemblies, said horizontal and vertical pitching blade assemblies lying in said common plane and defining therebetween said pitching station.

13. A concrete stone facing machine as claimed in claim 12 wherein said blade holders of said two pairs of pitching blade assemblies are each connected to a respective hydraulic cylinder, and guide means to maintain said pitching blade assemblies of each said pair in parallel relationship.

14. A concrete stone facing machine as claimed in claim 13 wherein each said pitching blade assemblies is provided with a pressure sensor to sense when said cutting edges contact a surrounding surface of a stone disposed at said pitching station.

15. A concrete stone facing machine as claimed in claim 14 wherein said hydraulic cylinders of said horizontal pair of blade assemblies are controlled by a first hydraulic valve and said hydraulic cylinders of said vertical pair of blade assemblies and controlled by a further hydraulic valve, said pressure sensor providing signals to a control device which operates said hydraulic cylinders through said first and second hydraulic valves.

16. A concrete stone facing machine as claimed in claim 15 wherein said hydraulic cylinders are rendered idle when said cutting edges of their associated pitching blade assemblies contact a surface of said stone and wherein immediately upon all said hydraulic cylinders being idled said hydraulic cylinders of at least one of said pairs of blade assemblies are actuated through its associated hydraulic valve at a higher pressure to penetrate said stone said predetermined distance.

17. A concrete stone facing machine as claimed in claim 16 wherein both said pairs of blade assemblies are actuated simultaneously.

18. A concrete stone facing machine as claimed in claim 3 wherein said pitching blades penetrate into its associated surface of said block a preset distance in the range of 4 to 20 millimeters from an outermost one of said forward projecting cutting edges.

19. A concrete stone facing machine as claimed in claim 18 wherein there is further provided passage means below said pitching station provided with conveying means for conveying concrete material chipped off said predetermined one of said surfaces of said stone away from said pitching station.

20. A concrete stone facing machine as claimed in claim 16 wherein said blade holder of each said pitching blade assemblies is secured to its associated hydraulic cylinder and guide means by articulated connections to compensate for irregularities in its associated surface of said stone.

21. A concrete stone facing machine as claimed in claim 14 wherein said conveyor is a driven roller conveyor for conveying stones in spaced apart relationship.

22. A concrete stone facing machine as claimed in claim 1 wherein said stop means is a stop bar connected to a motor driven adjustment mechanism whereby to position a stone arresting surface of said stop bar at a predetermined centered position with respect to said pitching station depending on the size of said stone.

23. A concrete stone facing machine as claimed in claim 1 wherein said pusher means is a motor driven pusher bar, a motor controlling the speed of displacement of said stone to said pitching station whereby to precisely position said stone with respect to said common plane of said pitching blade assemblies.

24. A concrete stone facing machine as claimed in claim 1 wherein there is further provided stone discharge means to transfer a stone from said pitching station to a discharge conveyor.

25. A concrete stone face machine as claimed in claim 24 wherein said stone discharge means is mounted on a motor driven carriage to displace transfer fingers to and away from said pitching station not to obstruct a lower horizontal pitching blade assembly, said transfer fingers being secured to said carriage, said carriage displacing said transfer fingers between driven rollers of said discharge conveyor to engage and lift a stone having been pitched at said pitching station and depositing same on said discharge conveyor.

26. A concrete stone face machine as claimed in claim 25 wherein said carriages are displaced on support rails by a chain link drive operated by a motor controlled by said control circuit, and a motor driven eccentric cam secured below said rails for lifting and lowering said frame and said transfer fingers, said rails being pivotally connected to a stationary frame.

27. A concrete stone face machine as claimed in claim 1 wherein roughing means is provided to impact said chipped irregular rough surface of said concrete stone along a discharge conveyor path to achieve a desired surface texture on said rough surface.

28. A concrete stone facing machine as claimed in claim 24 wherein there is further provided stone inverting cradles associated with said feed and or discharge conveyor whereby to orient said stones at a desired position on said conveyors, said inverting cradles being comprised by a series of right angled spaced-apart finger plates adapted to protrude between and above a section of said roller driven conveyors to lift a stone from said conveyors by actuating a first series of fingers to protrude between said rollers and engage a face of said stone and transfer said stone to an adjacent roller driven conveyor by tilting said stone to position an adjacent face thereof on a second series of fingers which descend between said rollers of said adjacent driven roller conveyor.

29. A method of forming a deep irregular rough surface in a face of a concrete stone having flat faces whereby said face is textured to resemble a real irregular chipped protruding stone face, said method comprising the steps of:

i) conveying a concrete stone in a predetermined oriented position to a loading station adjacent a pitching station, ii) arresting said stone at a predetermined position at said loading station in alignment with said pitching station, iii) providing at said pitching station two pairs of opposed blade assemblies, one pair being horizontal pitching blade assemblies and another pair being vertical pitching blade assemblies, each said pitching blade assemblies having a plurality of pitching blades secured in side-by-side relationship, each said pitching blades having a forward projecting cutting edge and a securing body portion, a first group of pitching blades having their cutting edges offset from the cutting edges of a second group of pitching blades and aligned along a first straight cutting axis which is parallel to a second straight cutting axis of said cutting edges of said second group of pitching blades, said pitching blade assemblies lying in a common vertical plane, iv) positioning said stone by pusher means on a support platform at said pitching station with said face to be textured projecting a predetermined distance beyond said common plane, v) clamping said stone on said support platform, vi) displacing said pitching blade assemblies alternately in pairs or simultaneously by associated cylinders to cause said pitching blades to move on an associated one of surrounding surfaces, vii) arresting said cylinders, viii) actuating said cylinders to cause said pitching blades to penetrate said face a predetermined distance to chip said surface to form said irregular rough surface, and ix) discharging said concrete block with said chipped irregular rough surface.

30. A method as claimed in claim 26, wherein said step (v) comprises sensing when said pitching blades contact said associated surfaces and wherein said step (viii) comprises applying increased pressure to said pitching blade assemblies to displace same into the surrounding surfaces of said block to chip said surface.

31. A method as claimed in claim 30 wherein there is further provided the step of conveying concrete material chipped off said face from under said pitching station to a remote area.

32. A method as claimed in claim 30 wherein there is further provided the step of roughing said chipped irregular rough surface by impact roughing means to achieve a desired surface texture.

33. A method as claimed in claim 30 wherein said step ii) comprises conveying a plurality of concrete stones in a predetermined spaced apart arrangement to said loading station by controlled synchronized means.

34. A pitching blade assembly for attachment to a piston operated frame of a concrete stone facing machine to pitch a concrete stone to form a deep irregular rough surface in a face of said stone surrounded by opposed flat surfaces, said frame having displacement limiting means, said pitching blade assembly comprising a blade holder, a plurality of pitching blades secured in side-by-side aligned relationship to said blade holder, each said pitching blades having a forward projecting cutting edge and a securing body portion, a first group of said pitching blades having their cutting edges aligned with a first straight cutting axis which is offset from the cutting edges of a second group of pitching blades aligned along a second straight cutting axis, said first and second cutting edges being parallel to one another.

35. A pitching blade assembly as claimed in claim 34 wherein said securing body portions of said pitching blades are secured in an elongated straight cavity of said blade holder and are disposed in side-by-side abutting relationship.

36. A concrete stone facing machine as claimed in claim 35 wherein said forward projecting cutting edge of each said pitching blades are straight cutting edges.

37. A concrete stone facing machine as claimed in claim 36 wherein said cutting edges of said second group of pitching blades aligned along said second straight cutting axis are recessed below said first straight cutting axis of said cutting edges of said first group of said pitching blades.

38. A concrete stone facing machine as claimed in claim 37 wherein said pitching blades are tungsten carbide blades and are secured to said blade holder by a two-component glue material.

39. A concrete stone facing machine as claimed in claim 37 wherein said cutting edges of said first group of pitching blades have a cutting head which is differently configured than the cutting head of said second group of pitching blades.

40. A concrete stone facing machine as claimed in claim 39 wherein said pitching blades are elongated rectangular blades, each blade having an elongated straight cutting edge, said cutting head having a transverse pyramidal shape defining a forward rearwardly inclined front bevel face leading to said elongated straight cutting edge and a rearwardly inclined rear bevel face depending downwardly from said cutting edge, said front bevel face and rear bevel face extending at different angles.

41. A concrete stone facing machine as claimed in claim 40 wherein said front bevel face of said cutting heads of said first group of pitching blades extend at a common angle different from a common angle of said rear bevel faces, said common angles of said front and rear bevel faces of said first group of pitching blades being different than the common angles of said front and rear bevel faces of said second group of said pitching blades.

42. A concrete stone facing machine as, claimed in claim 41 wherein said front bevel faces of said cutting heads of said second group of pitching blades are shallower than their said rear bevel face, and wherein said front bevel faces of said cutting heads of said first group of pitching blades are steeper than their said rear bevel face whereby to chip different size concrete chips to form said deep angular rough surface when said pitching blades are pitched to penetrate surfaces adjacent a face to be pitched of a stone positioned therebetween, said face to be pitched lying in a vertical plane.

43. A concrete stone facing machine as claimed in claim 37 wherein alternate ones of said pitching blades form said first group of pitching blades.

* * * * *